United States Patent [19]

Capano

[11] 4,318,503

[45] Mar. 9, 1982

[54] PISTOL HOLSTER WITH LOCK-IN MEANS

[75] Inventor: James J. Capano, Seaford, N.Y.

[73] Assignee: Manno Uniform and Security Equipment Corp., Seaford, N.Y.

[21] Appl. No.: 191,252

[22] Filed: Sep. 26, 1980

[51] Int. Cl.[3] ..... F41C 33/02

[52] U.S. Cl. ..... 224/244; 224/911

[58] Field of Search ..... 224/244, 242, 243, 245, 224/911, 912

[56] References Cited

U.S. PATENT DOCUMENTS

| | | | |
|---|---|---|---|
| 468,556 | 2/1892 | Anderson | 224/244 X |
| 1,113,530 | 10/1914 | Audley | 224/244 |
| 1,191,339 | 7/1916 | Noye | 224/911 X |
| 1,842,936 | 1/1932 | Franz | 224/243 |
| 1,851,352 | 3/1932 | Denkert | 224/243 X |
| 2,349,376 | 5/1944 | Ray | 224/911 X |
| 3,419,728 | 12/1968 | Wilson | 224/243 X |
| 3,420,420 | 1/1969 | Clark | 224/243 |
| 4,256,243 | 3/1981 | Bianchi et al. | 224/244 |
| 4,277,007 | 7/1981 | Bianchi et al. | 224/244 X |

*Primary Examiner*—Steven M. Pollard

*Attorney, Agent, or Firm*—Paul W. Garbo

[57] ABSTRACT

An improved pistol holster features lock-in means to prevent removal of the gun from the holster by an unauthorized person or by fall or other unexpected movement of the wearer of the holster. A pin attached to a flexible strap or flap on the outer wall of the holster extends through the trigger guard of the pistol and the end of the pin is captured in holding means fastened to the inner wall of the holster. Thus, the locked-in pistol cannot be withdrawn from the holster without first pulling the strap to separate the pin from the holding means.

8 Claims, 9 Drawing Figures

PISTOL HOLSTER WITH LOCK-IN MEANS

BACKGROUND OF THE INVENTION

This invention relates to safety gun holsters and more particularly to holsters provided with means to prevent unexpected and undesired removal of the gun from the holster.

In spite of many prior proposals of gun or pistol holsters featuring safety means to prevent an attacker from drawing the pistol from the holster of a law officer, each year many officers are shot by their own pistols because assailants were able to remove the pistols from the holsters. Apparently, these casualties occur because many of the proposals are so impractical that they have not been adopted or because the safety holsters in actual use fail to provide the intended protection for the wearers.

U.S. Pat. No. 4,076,156 to Katz points out that a common safety holster has a strap which passes from the rear wall of the holster over the gun and is snapped down on the front wall of the holster. Katz correctly observed that such safety strap is as readily released by an attacker as by the wearer of the holster. To make it more difficult for an assailant to remove the pistol from the holster, Katz used a strap pivotally fastened to the front wall and extending over the gun to the rear wall where the strap end engaged a snap fastener.

Another type of safety holster is shown in U.S. Pat. No. 1,851,352 to Denkert. This patentee used a spring latch attached to the rear wall of the holster. When the pistol was inserted into the holster, the leading portion of the trigger guard snapped past the spring latch. Then, the pistol could not be withdrawn unless the spring latch was depressed by a finger of the person removing the pistol from the holster. However, such person could easily be an attacker as well as the wearer of the holster.

A principal object of this invention is to provide a gun holster with safety means to prevent unexpected and undesired removal of the gun.

A further object is to make such safety means in the form of a pin that is easily inserted through and removed from the trigger guard of the gun in the holster.

Still another object is to make the safety means an inconspicuous part of the holster.

These and other objects and advantages of the invention will be evident from the description which follows.

SUMMARY OF THE INVENTION

In accordance with this invention, a pistol holster with lock-in means to prevent unexpected and undesired removal of the pistol simply and effectively comprises a long pin attached to a flexible strap on the front wall of the holster and positioned to pass through the trigger guard of the pistol to the rear wall of the holster where holding means are provided to receive and retain the end of the pin. To withdraw the pistol from the holster, the flexible strip must first be pulled to release the pin from the holding means.

The holsters of this invention are the type that are worn by law officers, armed services personnel and the like on their persons usually on a waist belt or on a shoulder strap. Generally such holsters are made of leather or plastic sheet developed to replace leather. The flexible strap to which the locking pin of the invention is attached is fastened to the holster and extends over, and preferably is part of, the front wall of the holster. The flexible strap is desirably made of the same material forming the holster so that it will be inconspicuous. However, any other flexible material such as strong canvas can be used to form the flexible strap. While one end of the strap is permanently achored to the holster, the other end is free but preferably provided with releasable fastening means such as a snap fastener or a magnetic fastener.

A simple and preferred form of the flexible strap is provided by two spaced slits in the front wall of the holster, desirably extending from a lower edge portion of the holster upwardly to the portion overlying the trigger guard of the pistol placed in the holster. Thus, the flexible strap is merely a slitted strip or flap of the front or outer wall of the holster with two advantages: economically simple construction and minimum visibility of the lock-in means of this invention.

The pin which is fastened to the flexible strap is a metal rod or bar extending horizontally through the holster to the rear wall thereof where holding means are affixed to receive the free end of the pin. While the free end of the pin may be plain or smooth, preferably it will be globular, knurled, serrated or otherwise formed to increase its retention by the holding means when the pistol is locked in the holster. A rod of about $\frac{1}{8}$ to $\frac{1}{4}$ inch diameter or a bar with a square, rectangular or other cross section of comparable dimensions will serve as an adequate pin to lock a pistol in the holster of this invention.

The holding means for the free end of the pin may be simply a tube or element into which the pin fits and is frictionally retained. For more positive retention of the pin end, the holding means will preferably include a spring such as is common in snap fasteners, or a magnetic metal part, or a slot into which the formed end of the pin can slide in dovetail fashion. When a slotted holder is used, it will be positioned so that any attempt to withdraw the pistol from the holster merely pulls the pin against the closed end of the slot thus thwarting withdrawal of the pistol. However, by first pulling the flexible strap to move the pin so that it escapes at the open end of the slotted holder, the pistol can be readily drawn from the holster.

BRIEF DESCRIPTION OF THE DRAWINGS

The further description of the invention will refer to the appended drawings of which.

DESCRIPTION OF PREFERRED EMBODIMENTS

Figure 1:
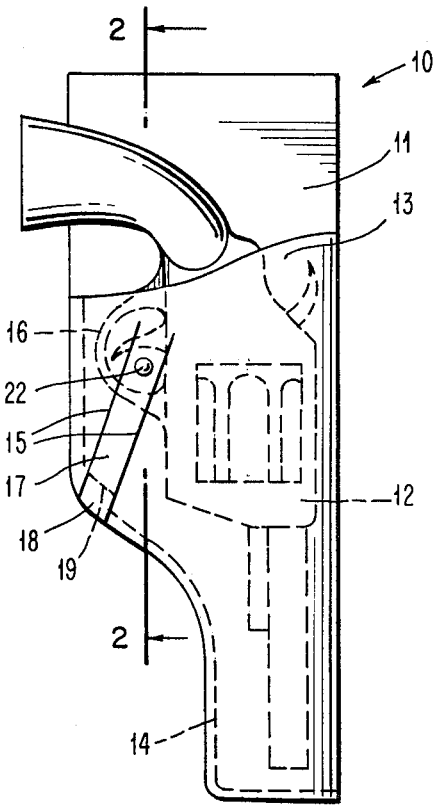
FIG. 1 is a front view of a holster with a preferred embodiment of the lock-in means of the invention and a pistol securely held in the holster.
Figure 2:
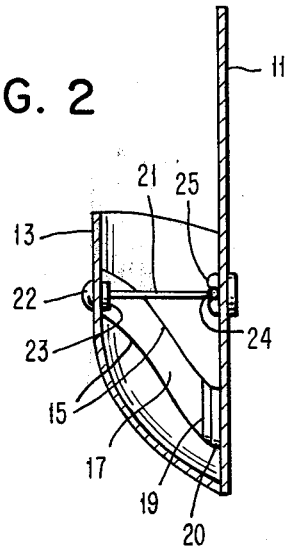
FIG. 2 is a cross-sectional view of the holster of FIG. 1 taken along the line 2—2, the pistol having been eliminated to show clearly the lock-in means of the invention.
Figure 3:
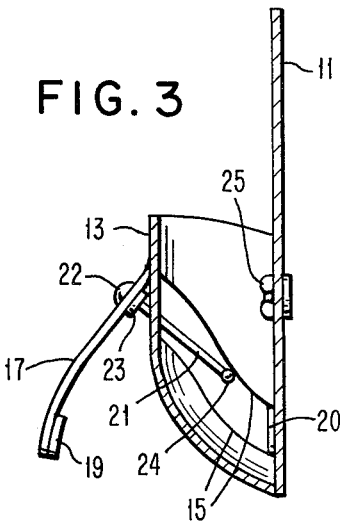
FIG. 3 is the same cross-sectional view shown in FIG. 2 but with the flexible strap pulled out to disengage the aforesaid lock-in means.

The holster of FIGS. 1, 2 and 3 is formed of leather or equivalent flexible sheet 10 which provides rear wall 11 and curves around pistol 12 to provide front wall 13 of the holster. The edges of front wall 13 and of rear wall 11 are held together by stitching 14 or by a bonding material to complete the pocket of the holster in which pistol 12 fits.

Front wall 13 has two slits 15 extending from the curved edge of the holster upwardly toward the area of trigger guard 16 of pistol 12 to form strap 17 therebetween. End 18 of strap 17 is not stitched down but has on its inner face a small piece of tape fastener 19 that holds end 18 down against rear wall 11 where mating tape fastener 20 is affixed. Tape fastener 19 and mating tape fastener 20 are available as the Velcro brand tape fastener offered by Velcro Corporation of New York, N.Y. In place of tape fasteners 19, 20, an ordinary fastener may be used to keep end 18 of strap 17 against rear wall 11 of the holster.

Pin 21 in the form of a rigid metal rod, usually steel, is permanently anchored to strap 17 by cap 22 and washer 23 on opposite sides of strap 17 so that pin 21 can be pushed through trigger guard 16 of pistol 12 as shown in FIG. 1. Pin 21 has a globular end 24 which snaps into snap catcher 25 affixed to rear wall 11 of the holster in the area opposite trigger guard 16 of pistol 12. With end 24 of pin 21 captured in snap catcher 25, pistol 12 cannot be drawn from the holster. However, a quick pull of end 18 of flexible strap 17 causes as shown in FIG. 3 separation of tape fasteners 19, 20 and release of pin end 24 from snap catcher 25 so that pistol 12 can be immediately drawn from the holster.

Figure 4:
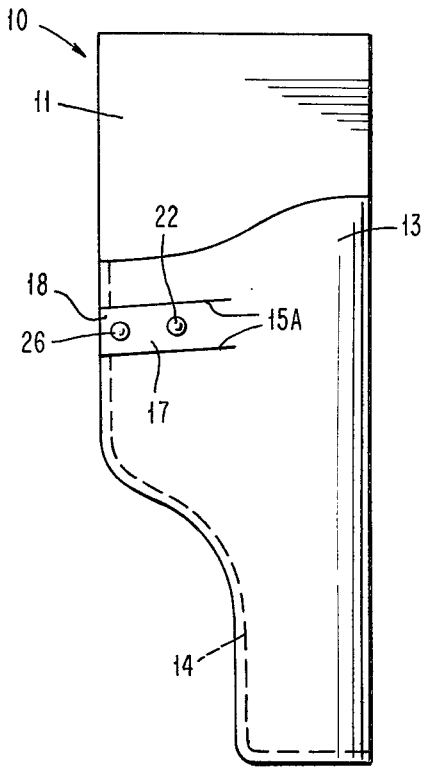
FIG. 4 is a front view of the holster differing from that shown in FIG. 1 only in the direction of the flexible strap used to engage or disengage the aforesaid lock-in means.

The holster of FIG. 4 is essentially the same as that of FIG. 1 differing therefrom only in the nearly horizontal direction of the two slits 15A and the use of a common snap fastener 26 in lieu of tape fasteners 19, 20 on end 18 of strap 17.

Figure 5:
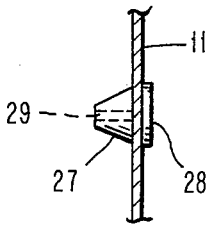
FIG. 5 is a fragmentary cross section of the rear wall of a holster showing a different holder for the end of the locking pin.

FIG. 5 is a fragmentary cross section of rear wall 11 of the holster showing holder 27 fastened thereto by back-up disk 28. Holder 27 is a simple element with bore 29 dimensioned so that pin end 24 fits snugly therein. For holder 27, pin 21 may terminate with a plain end rather than globular end 24 shown in FIG. 3. To increase the retention of the end of pin 21 in bore 29, holder 27 may desirably be made of rubber or a magnetic alloy such as the well-known Alnico alloy.

Figure 6:
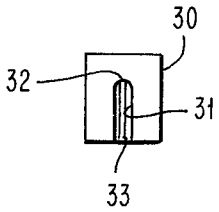
FIG. 6 is a front view of another holder for the end of the locking pin.
Figure 7:
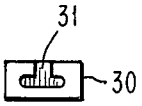
FIG. 7 is a bottom end view of the holder of FIG. 6.

FIGS. 6 and 7 show holder 30 with slot 31 extending partially therethrough. Holder 30 is affixed to rear wall 11 of the holster in place of snap catcher 25 shown in FIG. 3. Holder 30 is positioned so that closed end 32 of slot 31 is above the opposite open end 33.

Figure 8:
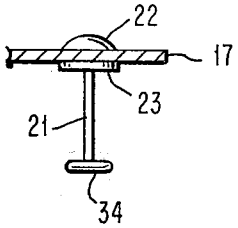
FIG. 8 is a longitudinal view of a pin with a shaped end designed to slide into the slotted holder of FIGS. 6 and 7.

FIG. 8 shows pin 21 attached to flexible strap 17 by cap 22 and washer 23. In this case, pin 21 has end 34 shaped to fit into open end 33 of slot 31 in holder 30 of FIGS. 6 and 7. Pin 21 with shaped end 34 can slide in dovetail fashion through slot 31 until it reaches closed end 32. A pistol locked in a holster equipped with pin 21 of FIG. 8 and holder 30 of FIGS. 6 and 7 cannot be withdrawn from the holster without first pulling strap 17 to move pin 21 downward so that end 34 escapes from open end 33 of slot 31 in holder 30. Othewise, any attempt to pull the pistol from the holster will only push end 34 of pin 21 against closed end 32 of slot 31 in holder 30 and thus frustrate the attempt.

Figure 9:
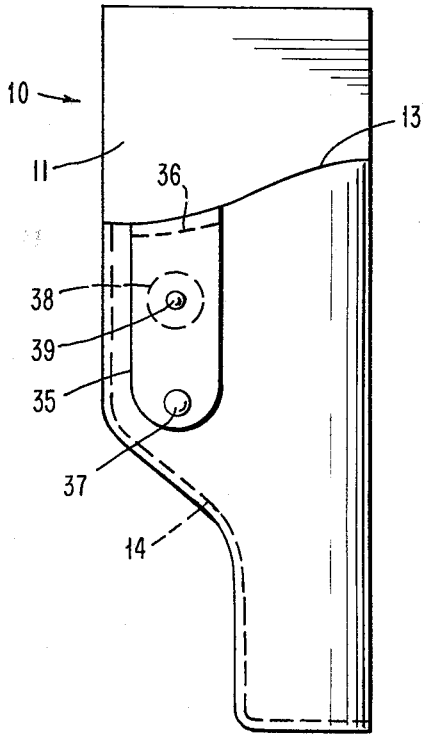
FIG. 9 is a front view of a holster with a separate flexible strap overlying and partially fastened to the front wall of the holster.

FIG. 9 shows a holster similar to that of FIG. 1 differing only in the flexible strap used to move the locking pin of this invention. In this case, front wall 13 does not have the two slits 15 to form strap 17 in FIG. 1. Instead, a separate strap 35 is fastened at one end to the upper edge of front wall 13 by stitching 36 or by a suitable bonding material. The opposite loose end of strap 35 is held against front wall 13 by snap fastener 37 or any other known fastener. Under strap 35, front walll 13 has a circular hole 38 in the area opposite the trigger guard of the pistol to be carried in the holster. Anchored to flexible strap 35 by cap 39 is a pin which extends through hole 38 and the trigger guard of the pistol placed in the holster. The end of the pin is suitably captured by holding means affixed to rear wall 11 of the holster as has been previously illustrated. Unless strap 35 is pulled up to undo snap fastener 37 and to release the pin from the holding means, the pistol cannot be taken out of the holster.

Many variations and modifications of the invention will be apparent to those skilled in the art without departing from the spirit or scope of the invention. Accordingly, only such limitations should be imposed on the invention as are set forth in the appended claims.

The term pistol is used herein generically for all guns intended to be held and fired with one hand, including automatics, semiautomatics and revolvers.

What is claimed is:

1. In a pistol holster, the improvement of lock-in means for the pistol comprising a flexible strap having one end attached to the front wall of said holster and extending over an opening in said front wall opposite the trigger guard of said pistol in said holster, a pin having one end fastened to said strap and extending through said trigger guard to the rear wall of said holster, and holding means affixed to said rear wall to receive the free end of said pin, said free end of said pin being released from said holding means by pulling the free end of said strap outwardly from said holster before drawing said pistol from said holster.

2. The improvement as set forth in claim 1 wherein the free end of the pin is globular and the holding means is a snap catcher.

3. The improvement as set forth in claim 1 wherein the free end of the flexible strap is provided with a releasable fastener for keeping said free end against the holster.

4. The improvement as set forth in claim 3 wherein the releasable fastener is a tape fastener having one element affixed to the inner side of the free end of the flexible strap and a mating element affixed to the holster.

5. The improvement as set forth in claim 1 wherein the flexible strap is formed by two spaced slits in the front wall of the holster disposed to position the free end of said strap at an edge of said holster.

6. The improvement as set forth in claim 5 wherein the free end of the flexible strap is provided with a releasable fastener for keeping said free end against the holster.

7. The improvement as set forth in claim 1 wherein the holding means is an element having an undercut slot with an open end and a closed end, said element being affixed to the rear wall of the holster so that said closed end is above said open end, and the free end of the pin has a form to fit in said slot through said open end in dovetail fashion.

8. The improvement as set forth in claim 1 wherein the holding means is an element made of a magnetic alloy and having a bore into which the free end of the pin fits, and said pin is a steel rod.

* * * * *